US005720654A

United States Patent [19]

Mac Donald

[11] Patent Number: 5,720,654

[45] Date of Patent: Feb. 24, 1998

[54] MANUAL SANDING DEVICE

[76] Inventor: Ronald E. Mac Donald, 823 E. Hayward Ave., Phoenix, Ariz. 85020

[21] Appl. No.: 751,029

[22] Filed: Nov. 15, 1996

[51] Int. Cl.[6] ..... B24D 15/00

[52] U.S. Cl. ..... 451/523; 451/524; 451/517

[58] Field of Search ..... 451/523, 524, 451/514–516, 517, 519, 504

[56] References Cited

U.S. PATENT DOCUMENTS

| | | | |
|---|---|---|---|
| 2,761,257 | 9/1956 | Mendelsohn | 451/523 |
| 3,510,991 | 5/1970 | Bowen | 451/523 |
| 4,730,430 | 3/1988 | Petrovich | 451/523 |
| 5,172,524 | 12/1992 | Poss | 451/517 |

FOREIGN PATENT DOCUMENTS

| | | | |
|---|---|---|---|
| 2074062 | 10/1980 | United Kingdom | 451/524 |
| 2241449 | 9/1991 | United Kingdom | 451/523 |

*Primary Examiner*—Robert A. Rose
*Assistant Examiner*—George Nguyen
*Attorney, Agent, or Firm*—Gregory J. Nelson

[57] ABSTRACT

A hand sanding block for use with an endless abrasive belt of the type normally used with power sanders. The block has a body and a slidable nose which is biased outwardly. A pin limits the outward travel of the nose relative to the body. A detent is provided so the nose may be temporarily secured in a retracted position for ease of loading and unloading sanding belts.

6 Claims, 2 Drawing Sheets

MANUAL SANDING DEVICE

BACKGROUND OF THE INVENTION

Field of the Invention

The present invention relates to a manual tool and more particularly to a sanding block for hand-sanding operations which accommodates an endless sanding belt of the type normally used with power belt sanders.

Sanding operations, particularly manual sanding operations for smoothing and abrading metal and wood surfaces, are commonly accomplished by use of cloth or paperbacked abrasive materials. These materials, commonly termed sandpaper, can be used without a sanding block but are generally more efficient and require less effort when used in conjunction with a sanding block. Sanding blocks may simply be a rectangular section of wood, such as a section of a 2×4, to which the sandpaper is applied, or may be a specially configured block having a curved resilient surface which receives the paper and has fastening means at opposite ends of the block. The fastening means are generally in the form of a spring or sharp projections which pierce the sandpaper to secure it in place.

While sanding blocks such as the type described above are convenient to use with sheets or strips of sandpaper, it is also desirable to use abrasive material of the endless belt type for hand sanding. The endless belt-type sanding material is generally intended for use with power sanders and, therefore, is generally more durable having a longer usable life. Also, the endless belt type of abrasive material has the advantage in that it may be advanced to replace a worn section of the material with an unused section.

There are a number of patents in the prior art which relate to appliances or devices for sanding work surfaces which are blocks having several sections or components to accommodate an endless sanding belt. Typical prior art patents representative of devices of this type are the following:

U.S. Pat. No. 3,510,991 shows a sanding block for supporting a continuous loop sanding belt. The block has first and second ends positioned within the belt with cam members positioned between the blocks. The cam members may be adjusted to force the blocks away from one another to secure the sanding belt in place.

U.S. Pat. No. 3,601,933 shows a sanding block for a continuous loop sanding belt which block has screw jack elements to loosen and tighten the belt assembly.

U.S. Pat. No. 4,242,843 shows a sanding block of the general type shaped to provide a wedging action to tension the belt.

U.S. Pat. No. 4,525,959 discloses a hand-held sanding tool for use with a continuous sanding belt. The tool has a unitary fork member with a removable edge which combine to retain the belt in place. Adjoining planar surfaces are angularly related to facilitate finishing operations.

U.S. Pat. No. 5,387,251 shows an endless belt sanding block which has a hinge construction.

U.S. Pat. No. 4,283,308 shows a hand-held sanding block formed by two blocks of like section disposed in co-planar relationship. The blocks are freely movable towards and away from each other by means of a pair of spaced dowel pins projecting from one block in telescoping engagement in spring loaded sockets in the other block.

Accordingly, it is a broad object of the present invention to provide a sanding block of the type employed for abrading purposes in conjunction with an endless loop sanding belt which is effective, easy to use and can be manufactured at relatively small cost.

Another object of the present invention is to provide a block sander that will securely hold an endless belt or loop-type abrading material in place when in use and which facilitates convenient loading and unloading of abrading material on the block.

SUMMARY OF THE INVENTION

In accordance with this invention, a hand sanding block is provided which has an elongate body with oppositely disposed, parallel, planar surfaces. One end of the body is curved and the opposite end of the body defines an opening which receives a reciprocal nose. The nose has an outer curved surface which, when the nose is in its extended loaded position, cooperates with the fixed curved surface on the opposite end of the body to tension and secure the sandpaper belt in place. The nose is outwardly biased by springs acting between the body and the nose. The opposite sides of the body define longitudinally extending recesses which the user may conveniently grasp to hold the block when engaged in sanding operations. Retaining means in the form of a projection or pin on the nose are received in a slot in the body and limit the outward reciprocation of the nose. For loading and unloading of abrading material, the nose may be retracted within the opening or recess at one end of the body and secured in the retracted position by a detent. Once the abrading material is in position, the detent is released to the loaded position by application of transversely applied force to the nose.

BRIEF DESCRIPTION OF THE DRAWINGS

The above and other objects and advantages of the present invention will be more fully understood from the following description, claims and drawings in which:

DETAILED DESCRIPTION OF THE DRAWINGS

Figure 5:
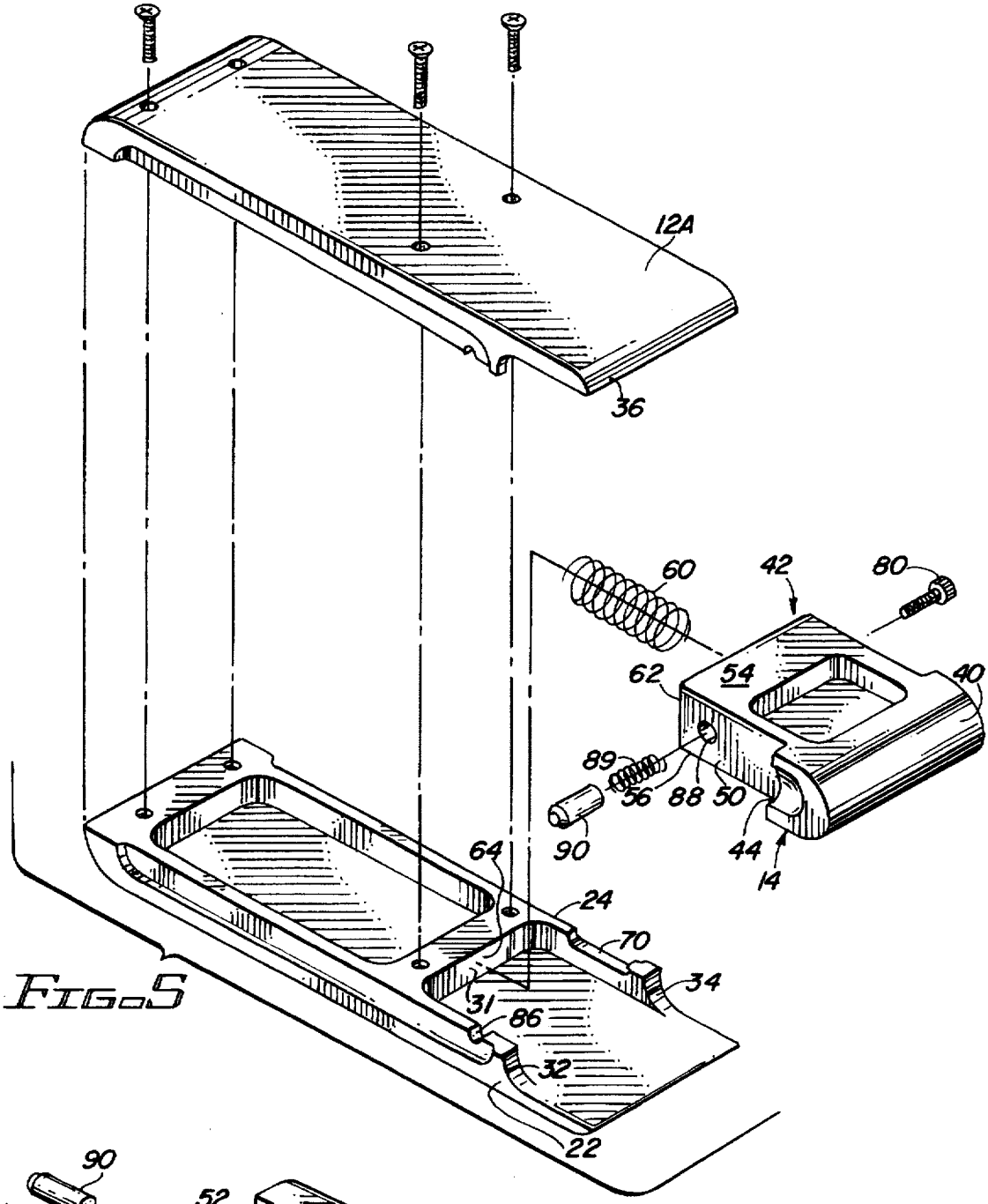
FIG. 5 is an exploded view of the sanding block.
Figure 6:
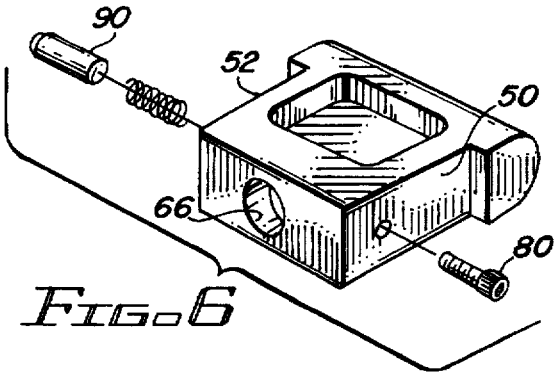
FIG. 6 is a perspective view of the nose of the block.

The sanding block of the present invention is generally designated by the numeral 10 and includes a body 12 having a nose 14. The body 12 is elongate having a generally planar upper surface 16 which is shown as being generally rectangular and an opposed, spaced-apart lower planar surface 18. One end of the body which will be referred to as the rear end 20 is convexly curved. Opposite parallel sides 22 and 24 extend between the upper and lower surfaces 16 and 18. Each of the sides is provided with a generally elongate cavity 25 which are provided to receive the thumb and fingers of the user at opposite sides of the block to assist in manual retention and manipulation of the block when sanding. The body 12 may be fabricated from like sections 12A and 12B which have relieved areas 28 to reduce weight and material. The sections may be joined by fasteners 29, as seen in FIG. 5.

The forward end of the block defines an opening 31 having rearwardly extending recesses 32, 34, provided in the opposite side walls 22, 24. The forward edge of the upper and lower planar surfaces are beveled at 36 as shown to smoothly contour into the curved, forward edge 40 of the nose 14. The nose is T-shaped having a body portion 42 extending rearwardly from the curved forward portion 40. The body portion 42 is dimensioned to be reciprocal within the opening 31 at the forward end of body 12. Opposite sides of the nose are provided with depressions 44 for oppositely receiving the thumb and finger of the user when loading and unloading abrasive material.

The nose has opposite side walls 50, 52 which slidably engage the opposite interior of sides 22, 24 of the main body. The opposite top and bottom surfaces 54, 56 slidably engage the opposite interior surfaces of cavity 31. When the sanding block is assembled with the nose in position, one or more biasing members shown as a coil spring 60 are interposed between the rear face 62 of the nose and the inner wall 64 of the forward recess or cavity 31 within the body. The spring is preferably seated at in a blind bore 66 in the nose to retain the spring in position.

Figure 1:
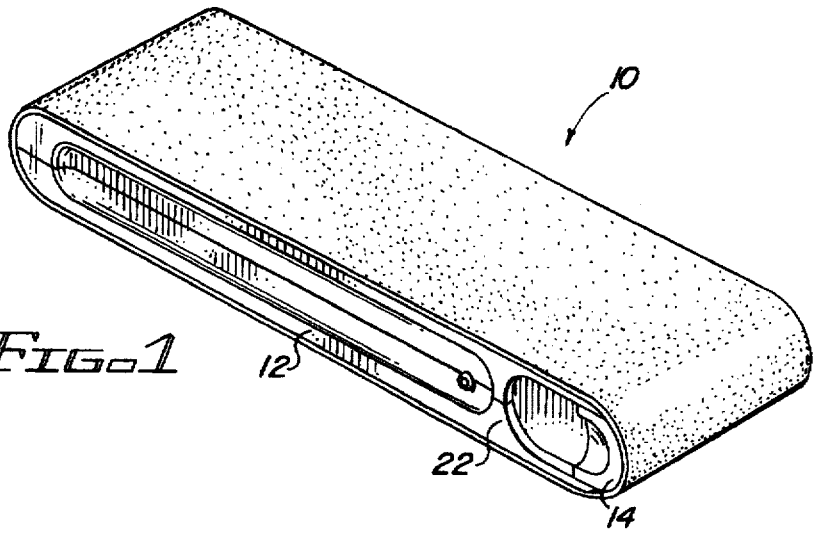
FIG. 1 is a perspective view of a sanding block in accordance with the present invention.
Figure 2:
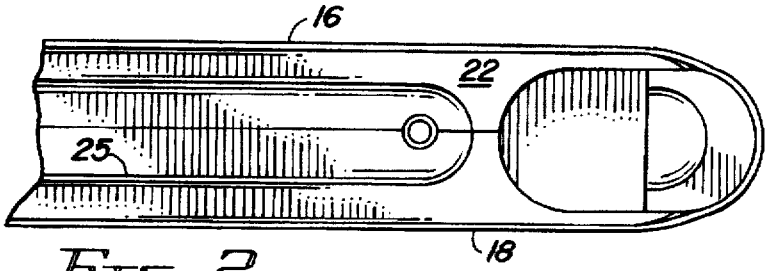
FIG. 2 is a fight side view of the front end of the block with the nose in the extended, loaded position.
Figure 2A:
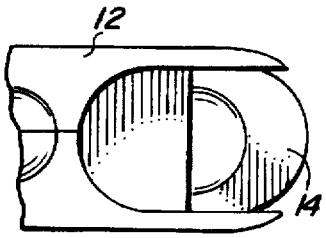
FIG. 2A is a right side view of the front end of the block with the nose in the retracted, unloaded position.
Figure 3:
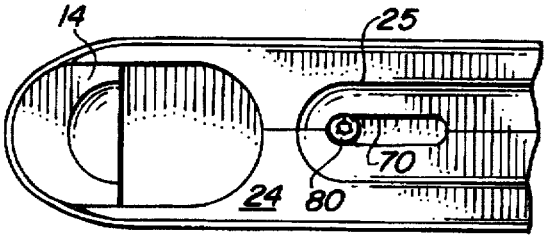
FIG. 3 is a left side view of the front end of the block with the nose in an extended, loaded position.
Figure 3A:
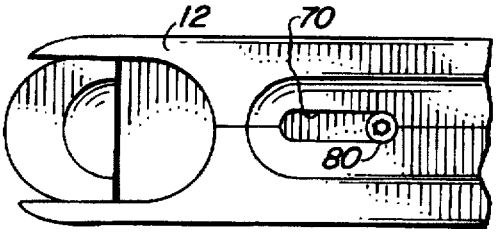
FIG. 3A is a view similar to FIG. 3 showing the nose retracted.

In order to maintain the nose within the body and limit its forward travel, an elongate slot 70 is provided at the forward end of one of the longitudinal cavities which slot extends through the side wall 24 into the cavity 31. A retaining member shown as a pin 80 projects from the side wall 52 of the nose through the slot. The pin 80 is positioned so that when the nose is fully extended in the operative position, the pin engages the forward end of the slot, as seen in FIG. 3. The elongate slot 80 permits the nose to be retracted to the position shown in FIG. 3A for loading and unloading of abrasive material.

Figure 4:
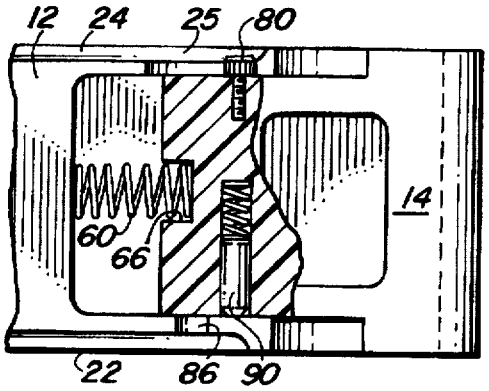
FIG. 4 is a partial plan view partly broken away showing the sanding block of the present invention with the nose in an extended position.
Figure 4A:
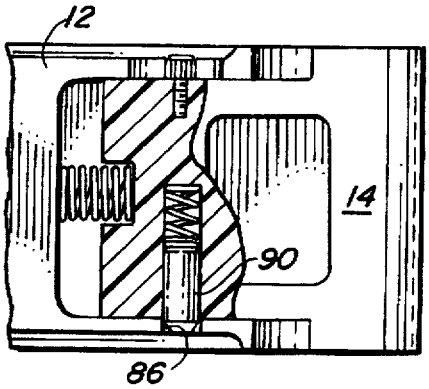
FIG. 4A is a view similar to FIG. 4 with the nose retracted.

The opposite longitudinal cavity in wall 22 defines a bore 86 which extends through the wall of the body into the opening at the forward end of the body. The adjacent side of the nose defines a transverse blind bore 88 in wall 50 which receives a spring 89 and a detent member 90. Detent member 90 may be in the form of a ball or a small pin and the detent is positioned so as to register with the bore or aperture 86 when the nose is in the retracted position as seen in FIG. 4A. When the user manually depresses the nose to the retracted position, the detent will lightly engage the bore to maintain this position. Abrasive material may be loaded or unloaded from the block as the tension applied by the nose to the endless loop of sandpaper is released. Once replacement abrasive material is positioned on the block, the detent is released either by applying manual force directly to the detent or by applying opposite inward manual force to recesses 44. Preferably the material of the nose will have sufficient flexibility so that the manual force applied to the nose will release the detent to allow the nose to return to the extended or loaded position.

The components of the sanding block may be of any suitable material such as wood, metal or plastic. Plastic is preferred and durable plastics such as Delrin are preferred. The portions of the nose and main body may also be made hollow to reduce the required material and also to reduce the resulting weight of the product. Accordingly, the sanding block of the present invention lends itself to fabrication by injection molding techniques.

In use, the user grasps the block at opposite sides at recesses 25 and with the other hand applies an inward manual force to the nose 14. The nose is forced to a retracted position, FIGS. 3A and 4A, in which the detent 90 will be in registry with bore 86 retaining the nose in the retracted position. In this position, the abrasive material such as an endless loop or belt of sandpaper can easily be placed over the sanding block or removed from the sanding block as necessary. Once a spent or exhausted belt has been removed and a new belt replaced, the detent is released either by inward pressure on the detent or pressure on the opposite recesses 44 of the nose. Release of the detent will allow the nose to move to its extended position due to the biasing force of the springs. In the forward position, the nose will apply tensioning pressure to the belt loop.

In use, sanding flat surfaces can be accomplished by reciprocation of the sandpaper on either planar surface 16 or 18 against the workpiece. Sanding of smaller pieces or curved surfaces can be accomplished by using the nose end 14 or the rear end 20 of the block.

From the foregoing it will be seen that the present invention provides a simple, inexpensive and highly efficient sanding block for a holding belt or endless loop type of abrasive materials. The device enables the user to readily install and remove the abrasive material and provides a positive tensioning of the belt once in place on the body preventing slacking and wrinkling of the abrasive paper.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A sanding block comprising:

(a) a body having opposite, generally planar top and bottom surfaces, opposite sides and a front and rear end, said front end defining a recess extending rearwardly and extending between the opposite sides of the body;

(b) a nose slidably received in said recess between a forward and retracted position, said nose having a curved front surface;

(c) biasing means interposed between said body and said nose normally urging said nose to said forward position;

(d) travel limiting means on said nose and engageable with said body for limiting the extent of forward movement of said nose; and (e) detent means on said nose and engageable with said body for releasably securing said nose in said retracted position, said detent means comprising a transverse blind bore in said nose, spring means in said blind bore and pin means slidable in said bore, said pin means being in biased engagement with said spring means and wherein said pin means is in selective registry with an aperture defined by a side of said body.

2. The sanding block of claim 1 wherein said body and nose are fabricated from plastic.

3. The sanding block of claim 1 wherein said travel limiting means comprises projection means extending from the side of said block and wherein one of said sides of said body defines an elongate slot in registry with said projection means.

4. The sanding block of claim 1 wherein said top and bottom surfaces are configured to smoothly conform to the shape of the said nose.

5. The sanding block of claim 1 wherein said opposite sides of said body define elongate slots adapted to receive the thumb and finger of the user.

6. The sanding block of claim 1 wherein said nose defines oppositely extending depressions whereby manual force applied at said depressions will disengage said detent means to allow said nose to move from said retracted position.

* * * * *